US010441966B2

(12) United States Patent
Liu et al.

(10) Patent No.: US 10,441,966 B2
(45) Date of Patent: Oct. 15, 2019

(54) COATING APPARATUS

(71) Applicants: BOE TECHNOLOGY GROUP CO., LTD., Beijing (CN); HEFEI BOE DISPLAY TECHNOLOGY CO., LTD., Hefei, Anhui (CN)

(72) Inventors: Ying Liu, Beijing (CN); Xiaohan Ling, Beijing (CN); Anlong Xu, Beijing (CN); Zhiyu Qian, Beijing (CN); Changquan Shen, Beijing (CN)

(73) Assignees: BOE TECHNOLOGY GROUP CO., LTD., Beijing (CN); HEFEI BOE DISPLAY TECHNOLOGY CO., LTD., Hefei, Anhui (CN)

( * ) Notice: Subject to any disclaimer, the term of this patent is extended or adjusted under 35 U.S.C. 154(b) by 0 days.

(21) Appl. No.: 15/742,270

(22) PCT Filed: Jun. 20, 2017

(86) PCT No.: PCT/CN2017/089170

§ 371 (c)(1),
(2) Date: Jan. 5, 2018

(87) PCT Pub. No.: WO2018/076726

PCT Pub. Date: May 3, 2018

(65) Prior Publication Data

US 2019/0001367 A1 Jan. 3, 2019

(30) Foreign Application Priority Data

Oct. 24, 2016 (CN) ..... 2016 1 156305

(51) Int. Cl.
*B05C 5/02* (2006.01)
*B05B 13/04* (2006.01)
(Continued)

(52) U.S. Cl.
CPC ..... *B05C 5/0216* (2013.01); *B05B 3/02* (2013.01); *B05B 13/0431* (2013.01); *B05C 5/02* (2013.01);
(Continued)

(58) Field of Classification Search
USPC ..... 118/300, 313, 315, 305, 321, 323
See application file for complete search history.

(56) References Cited

U.S. PATENT DOCUMENTS 7,473,320 B2 * 1/2009 Lee ..... B05C 5/027 118/313
8,443,753 B2 * 5/2013 Tanaka ..... B41J 11/0015 118/302
(Continued)

FOREIGN PATENT DOCUMENTS

CN 102773199 A 11/2012
CN 103706517 A 4/2014
(Continued)

OTHER PUBLICATIONS

International Search Report and Written Opinion dated Sep. 20, 2017; PCT/CN2017/089170.

*Primary Examiner* — Yewebdar T Tadesse

(57) ABSTRACT

A coating apparatus is provided. The coating apparatus includes a coater, configured to move and perform coating along a first direction, the coater includes a coating head and a coating head movement mechanism, the coating head movement mechanism is configured to make the coating head move along a plane intersected with the first direction and rotate in the plane intersected with the first direction.

13 Claims, 3 Drawing Sheets

(51) Int. Cl.

| | |
|---|---|
| ***B05C 9/08*** | (2006.01) |
| ***B05B 3/02*** | (2006.01) |
| *B05B 7/22* | (2006.01) |
| *B05D 1/26* | (2006.01) |

(52) U.S. Cl.
CPC ..... *B05C 9/08* (2013.01); *B05B 7/228* (2013.01); *B05C 5/0254* (2013.01); *B05D 1/26* (2013.01); *B05D 2252/00* (2013.01)

(56) References Cited

U.S. PATENT DOCUMENTS

| | | | | |
|---|---|---|---|---|
| 2003/0151167 | A1* | 8/2003 | Kritchman | B29C 41/48 264/401 |
| 2007/0054060 | A1* | 3/2007 | Miura | H01L 51/0004 427/427.3 |
| 2007/0069744 | A1* | 3/2007 | Koyagi | G01R 1/06716 324/756.03 |
| 2015/0224765 | A1* | 8/2015 | Fukasawa | B41J 3/28 347/37 |

FOREIGN PATENT DOCUMENTS

| | | | |
|---|---|---|---|
| CN | 103962281 | A | 8/2014 |
| CN | 105772340 | A | 7/2016 |
| CN | 206168698 | U | 5/2017 |
| JP | 3199594 | U | 8/2015 |

* cited by examiner

COATING APPARATUS

TECHNICAL FIELD

At least one embodiment of the present disclosure relates to a coating apparatus.

BACKGROUND

In the technical field of TFT-LCD (Thin Film Transistor-Liquid Crystal Display), in the OLB (Outer Lead Bonding) projection ultraviolet light coating process, in order to achieve the purposes of preventing the lead from being corroded due to the electrodes after bonding being exposed in the air and avoid light leakage, three processes including a front coating process, a back coating process and a side sealing process are mainly included. The back coating process and the side sealing process can be selectively performed according to the product design and the requirements of customers, and the front coating process is performed to the products of all types. In order to apply three different coating processes, the currently used UV coating apparatus is respectively designed with three coating units, respectively including a front coating unit, a back coating unit, and a side sealing unit, and each of the units respectively use 1-2 coater(s) to perform the coating process.

SUMMARY

At least one embodiment of the present disclosure provides a coating apparatus. The coating apparatus is a switchable integrated apparatus, which can utilize a coater to perform a front coating process, a back coating process and a side coating process, so as to save the apparatus costs and improve the utilizing rate of the apparatus.

At least one embodiment of the present disclosure provides a coating apparatus, which includes: a coater, configured to move and perform coating along a first direction, the coater includes a coating head and a coating head movement mechanism, the coating head movement mechanism is configured to drive the coating head to move in a plane intersected with the first direction and to rotate in the plane intersected with the first direction.

BRIEF DESCRIPTION OF THE DRAWINGS

In order to clearly illustrate the technical solution of the embodiments of the invention, the drawings of the embodiments will be briefly described in the following; it is obvious that the described drawings are only related to some embodiments of the invention, not limitative to the present disclosure.

REFERENCE MARKS

Figure 1:
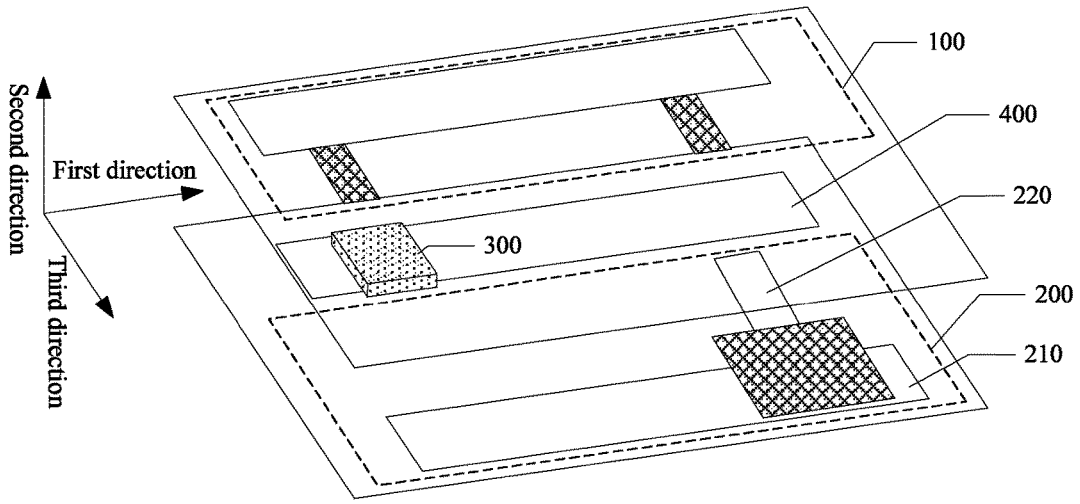
FIG. 1 is a structural schematic diagram of a coating apparatus provided by an embodiment of the present disclosure.

100—transport mechanism; 101—first sub transport mechanism; 102—second sub transport mechanism; 110—first transport guide rail; 120—second transport guide rail; 130—grabbing head; 200—coating platform; 210—first coating guide rail; 220—second coating guide rail; 230—rotating portion; 300—coater; 310—coating head; 311—coating end; 320—coating head movement mechanism; 400—first propulsion mechanism; 410—first guide rail; 420—roller; 500—second propulsion mechanism; 600—rotating structure; 610—driving motor; 611—output shaft; 620—coating head shaft; 630—driving belt; 640—fixing portion; 700—curing lamp; 900—object to be coated; 901—array substrate polarizer; 902—array substrate; 903—opposed substrate; 904—opposed substrate polarizer; 905—chip on array.

DETAILED DESCRIPTION

In order to make objects, technical details and advantages of the embodiments of the present disclosure apparent, the technical solutions of the embodiment will be described in a clearly and fully understandable way in connection with the drawings related to the embodiments of the present disclosure. It is obvious that the described embodiments are just a part but not all of the embodiments of the disclosure. Based on the described embodiments herein, one person skilled in the art can obtain other embodiment(s), without any inventive work, which should be within the scope of the present disclosure.

Unless otherwise defined, all the technical and scientific terms used herein have the same meanings as commonly understood by one of ordinary skill in the art to which the present disclosure belongs. The terms "first," "second," and so on which are used in the description and the claims of the present application for invention, are not intended to indicate any sequence, amount or importance, but distinguish various components. The terms "includes," "including," "includes," "including," etc., are intended to specify that the elements or the objects stated before these terms encompass the elements or the objects and equivalents thereof listed after these terms, but do not preclude the other elements or objects. The phrases "connect", "connected", etc., are not intended to define a physical connection or mechanical connection, but may include an electrical connection, directly or indirectly.

A conventional coating apparatus may include three coating units respectively designed for performing three different coating processes, the three coating units respectively are a front coating unit, a back coating unit, and a side sealing unit; each of the units respectively use 1-2 coaters to respectively perform the coating processes, such as a front coating process, a back coating process, and a side sealing process. In the research, the designer(s) of the present application has noticed that: upon a product with gate drive on array (GOA) being manufactured, in addition to the front coating and back coating process, the product with gate on array also requires a side sealing process, thus, the coating apparatus requires three coating units; if the production line is provided with three coating units, including a front coating unit, a back coating unit, and a side sealing unit; when the production line manufactures a conventional product, since the conventional product only requires the front coating process and the back coating process, the front coating unit and the back coating unit are used, but the side sealing unit is unused, thereby resulting in a low utilizing rate of the apparatus, and increasing unnecessary loss of energy and material. If the production line is only provided with two units, for example, a front coating unit and a back coating unit, when the product line is transitioned to manufacture a product with gate drive on array, since it is required to perform a side sealing process, the production line cannot satisfy the requirements, thereby resulting in other loss. At another aspect, since three bonding edges of a conventional product is required to be coated, each of the units respectively requires a plurality of coaters to perform the coating process. However, only one bonding edge of a product with gate drive on array (GOA) is required to be coated, upon manufacturing a product with gate drive on array (GOA), the coaters used for manufacturing a conventional product in the coating apparatus would be unused, thereby resulting in a low utilizing rate of apparatus and increasing unnecessary loss of energy and material. Besides, if the coating unit or coaters is not used for a long time, the curable adhesive (for example, UV curable adhesive) would be cured in the pipes, so as to affect the apparatus life and the subsequent coating effect; thus, upon the coating unit or coaters is unused for a long time and re-enabled, it is required to perform works such as discharging the adhesive and re-adjusting the coating parameters, so as to affect the utilization.

Embodiments of the present disclosure provide a coating apparatus, including a coater which can move and coat along a first direction, the coater includes a coating head and a coating head movement mechanism, the coating head movement mechanism is configured to make the coating head move in a plane intersected with the first direction and rotate in a plane intersected with the first direction. The coating apparatus is a switchable integrated apparatus, which can utilizes one coater to perform three different processes including a front coating process, a back coating process and a side sealing process, so as to save the apparatus costs and improve the utilizing rate of the apparatus.

Hereafter, the coating apparatus provided by the embodiments of the present disclosure will be described in detail with reference to the accompanying drawings.

First Embodiment

Figure 2A:
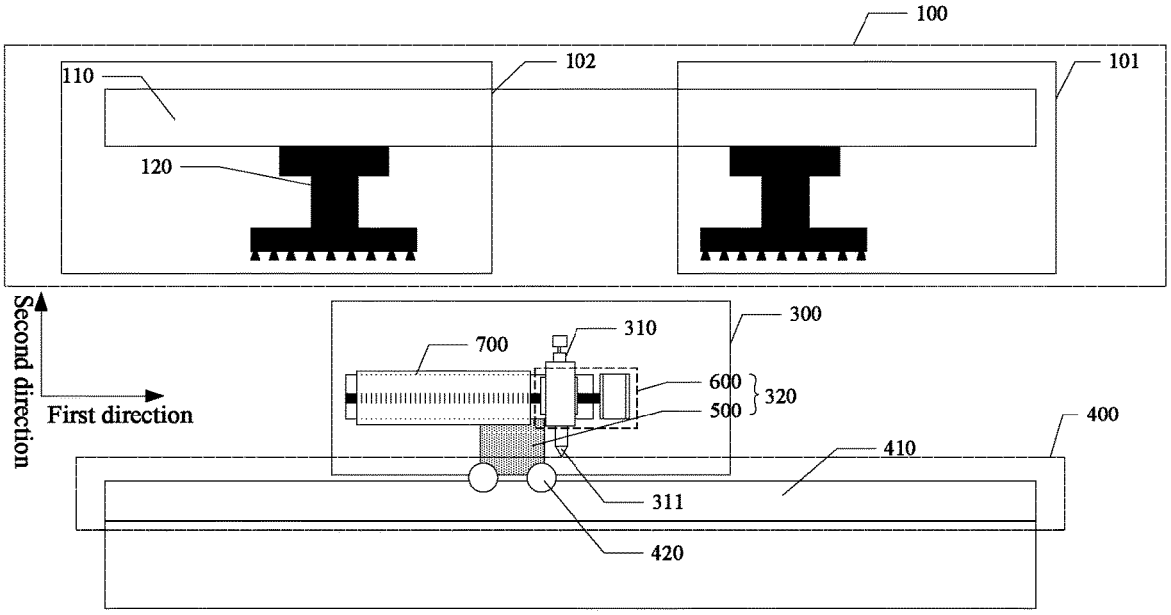
FIG. 2*a* is a front view of a coating apparatus provided by an embodiment of the present disclosure.

The present embodiment provides a coating apparatus, as illustrated by FIG. 1, the coating apparatus includes a coater 300, which can be used to perform a coating process along a first direction. As illustrated by FIG. 2*a*, the coater 300 includes a coating head 310 and a coating head movement mechanism 320, the coating head movement mechanism 320 can make the coating head 310 move in a plane intersected with the first direction and rotate in the plane intersected with the first direction, that is to say, the coating head movement mechanism 320 can be used to make a coating end 311 of the coating head 310 move along a curved line in the plane intersected with the first direction. It is to be noted that, the first direction is a horizontal direction in the paper plane in FIG. 2*a*; certainly, the present disclosure is not limited thereto, the first direction is not limited to the first direction illustrated in FIG. 2*a*, and can be set according to the practical requirements.

In the coating apparatus provided by the present embodiment, by providing a coater including a coating head and a coating head movement mechanism, the coating head can move in the plane intersected with the first direction and rotate in the plane intersected with the coating head movement mechanism. Thus, the coater can independently realize a front coating process, a back coating process and a side sealing process by using the coating head movement mechanism to adjust the position and angle of the coating head. That is to say, the coating apparatus provided by the present embodiment can realize the front coating process, the back coating process and the side sealing process by only disposing one coater; such that the production line adopting the coating apparatus provided by the present embodiment can be applied to different products such as conventional products and products with gate drive on array (GOA), without resulting in the problems, such as leaving the coater unused and low utilizing rate of the coating apparatus, so as to further avoid unnecessary loss of energy and materials. Moreover, upon the production line utilizing the coating apparatus provided by the present embodiment being transitioned to manufacture products with a different type, it is only required to adjust the working mode of the coater, and it is not required to conduct the works such as discharging the adhesive and adjusting the coating parameters, thus, the utilization can be improved.

For example, in the coating apparatus provided by an example of the present embodiment, as illustrated by FIG. 1, the coating apparatus further includes a transport mechanism 100 and a coating platform 200. The transport mechanism 100 is configured to transport an object to be coated; and the coating platform 200 is configured to support the object to be coated (for example, a liquid crystal display panel to be coated), the first direction is parallel to a plane where the coating platform is located. Thus, the coating apparatus can transport the object to be coated through the transport mechanism, support the object to be coated through the coating platform, and coat the object to be coated which is supported on the coating platform.

For example, in the coating apparatus provided by an example of the present embodiment, as illustrated by FIG. 2*a*, the coating head movement mechanism is configured to make the coating head move along a second direction perpendicular to the coating platform and rotate in a plane perpendicular to the first direction. It is to be noted that, the first direction is a horizontal direction in the paper plane of FIG. 2*a*; the second direction is a vertical direction in the paper plane of FIG. 2*a*; certainly, the present disclosure comprises but is not limited thereto, the first direction and the second direction are not limited to the first direction and the second direction illustrated in FIG. 2*a*, and can be set according to the practical requirements.

Figure 5A:
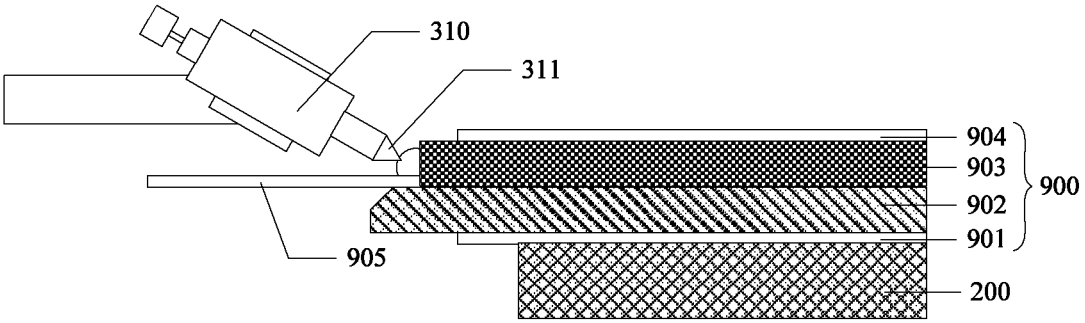
FIG. 5*a* is a schematic diagram of an operating process of a coating apparatus provided by an embodiment of the present disclosure.

For example, upon the coating apparatus provided by the present embodiment of the present disclosure being applied to a front coating process, as illustrated by FIG. 5*a*, the coating head 310 can be moved to a position above the coating platform 200 through the coating head movement mechanism, and a rotating angle of the coating head 310 can be adjusted by using the coating head movement mechanism to rotate in a plane perpendicular to the first direction, such that the coating head 310 is located in a down position, and can perform a front coating process to a position to be coated of the object 900 to be coated.

For example, the object 900 to be coated is a liquid crystal display panel. As illustrated by FIG. 5*a*, the liquid crystal display panel includes an array substrate polarizer 901, an array substrate 902, an opposed substrate 903, an opposed substrate polarizer 904, and a COF 905 (Chip on Film) disposed at an edge of the array substrate 902 which are sequentially disposed on the coating platform 200. The array substrate 902 has a display region used for displaying and a fan out region located at the periphery of the display region, the tips of lead lines in the display region is located in the fan out region; the COF 905 is provided with lead lines or electrodes, the COF 905 is used to connect and bond the tips in the fan out region of the array substrate 902 through these lead lines or electrodes. The coating head 310 is moved to a position above the coating platform 200 through the coating head movement mechanism, and the rotating angle of the coating head 310 is adjusted by the rotation of the coating head movement mechanism in a plane perpendicular to the first direction, that is to say, and the coating end 311 revolves along a curved line in the plane perpendicular to the first direction. In this way, the coating head 310 can coat liquid photo-curable adhesive at a position of the COF 905 away from the array substrate 902 and close to the opposed substrate 903, so as to prevent the lead lines or electrodes from being exposed in the air after bonding, so as to further prevent the electrodes being corroded and avoid the light leakage phenomenon.

Figure 5B:
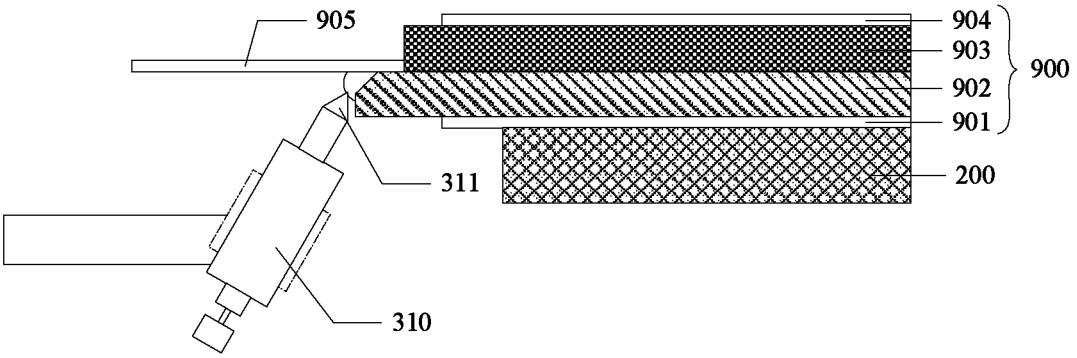
FIG. 5*b* is a schematic diagram of another operating process of a coating apparatus provided by an embodiment of the present disclosure.

For example, upon the coating apparatus provided by the embodiment of the present disclosure being applied to a back coating process, as illustrated by FIG. 5*b*, the coating head 310 moves to a position under the coating platform 200 through the coating head movement mechanism, and the rotating angle of the coating head 310 is adjusted by the rotation of the coating head movement mechanism in the plane perpendicular to the first direction, such that the coating head 310 is located in an up position, and can perform a back coating process to a position to be coated of the object 900 to be coated.

For example, the object 900 to be coated is the above-mentioned liquid crystal display panel. As illustrated by FIG. 5*b*, the coating head 310 is moved to a position under the coating platform 200 through the coating head movement mechanism, and the rotating angle of the coating head 310 is adjusted by the rotation of the coating head movement mechanism in the plane perpendicular to the first direction, such that the coating head can coat liquid photo-curable adhesive at a position of the COF 905 close to the array substrate 902, so as to prevent the lead lines or electrodes from being exposed in the air after bonding, so as to further prevent the electrodes being corroded and avoid the light leakage phenomenon.

Figure 5C:
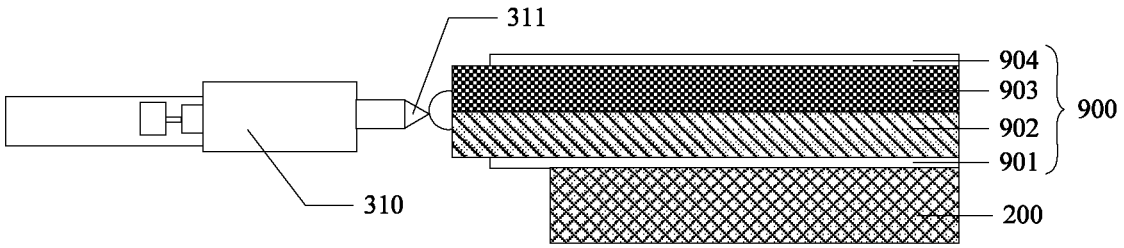
FIG. 5*c* is a schematic diagram of another operating process of a coating apparatus provided by an embodiment of the present disclosure.

For example, upon the coating apparatus provided by the present embodiment of the present disclosure being applied to a side sealing process, as illustrated by FIG. 5*c*, the coating head 310 is moved to a position above the coating platform 200 through the coating head movement mechanism, and the rotating angle of the coating head 310 is adjusted by the rotation of the coating head movement mechanism in the plane perpendicular to the first direction, so as to make the coating head 310 in a horizontal plane with the object 900 to be coated and perform a side sealing process at a position to be coated of the object 900 to be coated.

For example, the object 900 to be coated is the above-mentioned liquid crystal display panel. As illustrated by FIG. 5*c*, the coating head 310 is moved to a position above the coating platform 200 through the coating head movement mechanism, and the rotating angle of the coating head 310 is adjusted by the rotation of the coating head movement mechanism in the plane perpendicular to the first direction, so as to make the coating head 310 be level with an interface between the array substrate 902 and the opposed substrate 903. That is to say, the coating head 310 and the interface between the array substrate 902 and the opposed substrate 903 are in the same horizontal plane. In this way, the coating head 310 can coat liquid photo-curable adhesive at the crevice between the array substrate 902 and the opposed substrate 903, to as to perform a side sealing process.

It is to be noted that, the abovementioned object to be coated is a liquid crystal display panel. However, the present disclosure comprises but is not limited thereto, and the object to be coated can be other objects, for example, an organic light emitting diode display panel.

Second Embodiment

On the basis of the first embodiment, the present embodiment provides a coating apparatus. As illustrated by FIG. 1, the coating apparatus includes a transport mechanism 100, a coating platform 200 and a coater 300. The coating platform 200 and the coater 300 can be disposed in the same plane, and the transport mechanism 100 can be disposed in a plane which is higher than the plane where the coating plane 200 and the coater 300 are disposed. Certainly, the present embodiment comprises but is not limited thereto.

For example, in the coating apparatus provided by an example of the present embodiment, as illustrated by FIG. 2*a*, the coating apparatus further includes a first propulsion mechanism 400. The first propulsion mechanism 400 includes a first guide rail 410, the first guide rail 410 is extending along the first direction, the coater 300 is disposed on the first guide rail 410, and the first propulsion mechanism 400 is configured to make the coater 300 move along the first direction. For example, the first propulsion mechanism 400 further includes a roller 420 and a motor (which is not shown in the accompanying drawings) driving the roller 420, the roller 420 can be disposed on the first guide rail 420 and connected with the coater 300. Thus, the first propulsion mechanism 400 can drive the roller 420 through the motor to move along the first direct on the first guide rail 410, such that the coater 300 can perform a coating process along the first direction.

It is to be noted that, the present embodiment is described by taking an example where the first propulsion mechanism 400 includes the first guide rail 410, but is not limited thereto. For example, the first propulsion mechanism can be a first direction screw, to enable the coater move precisely. Or, the first propulsion mechanism can be a translation air cylinder.

For example, in the coating apparatus provided by an example of the present embodiment, as illustrated by FIG. 2*a*, the coating head movement mechanism 320 includes a second propulsion mechanism 500 and a rotating structure 600; the second propulsion mechanism 500 is configured to make the coating head 310 move along the second direction; and the rotating structure 600 is configured to make the coating head 310 rotate in a plane perpendicular to the first direction. Thus, the coating head movement mechanism 320 realize making the coating head 310 move along the second direction perpendicular to the coating platform 200 and rotate in the plane perpendicular to the first direction respectively through the second propulsion mechanism 500 and the rotating structure 600. Besides, the coating apparatus provided by the present embodiment has a simple and reliable structure.

Figure 2B:
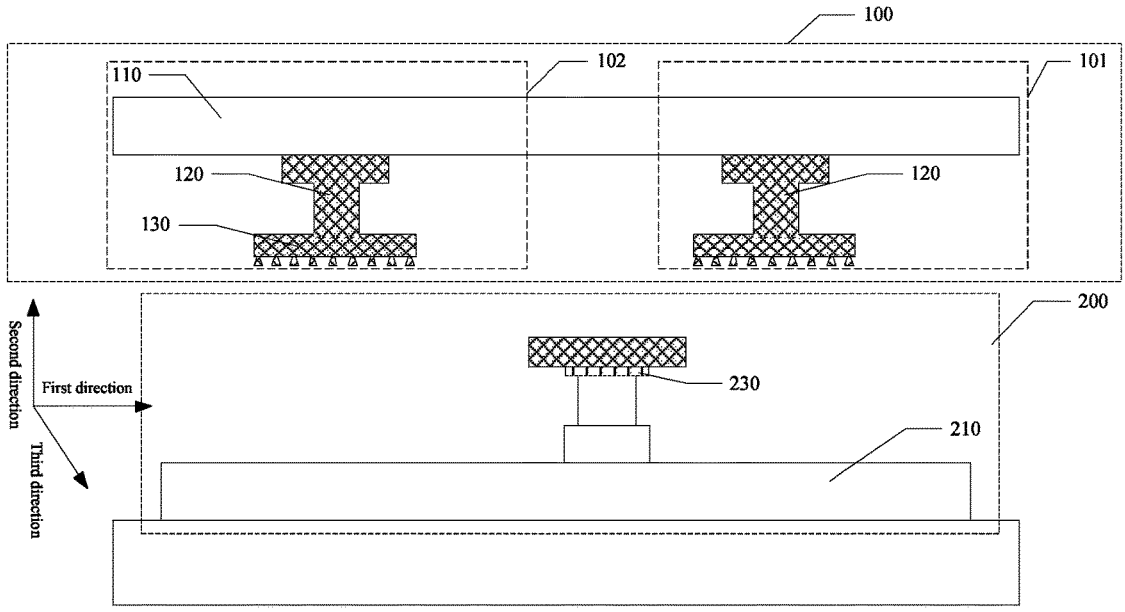
FIG. 2*b* is a front view of another coating apparatus provided by an embodiment of the present disclosure.

For example, in the coating apparatus provided by an example of the present embodiment, as illustrated by FIG. 2*b*, the transport mechanism 100 includes a first sub transport mechanism 101 and a second sub transport mechanism 102, the first sub transport mechanism 101 is configured to transport the object to be coated to the coating platform 200, the second sub transport mechanism 102 is configured to transport the object to be coated out of the coating platform 200. Thus, by disposing two sub transport mechanism (i.e., the first sub transport mechanism 101 and the second transport mechanism 102), upon performing coating processes to a plurality of objects to be coated, the coating apparatus can perform the shift-in and shift-out movements at the same time, such that the coating apparatus can realize fast transportation, so as to reduce the tract time. It is to be noted that, the present embodiment is described by taking an example where two sub transport mechanisms are provided, but is not limited thereto. The sub transport mechanisms may be one or more. Besides, because the coater 300 and the coating platform 200 are disposed in the same plane, in order to clearly illustrate the coater 300 and the coating platform 200, FIG. 2*a* and FIG. 2*b* respectively illustrate the front schematic view of the coating apparatus.

For example, in the coating apparatus provided by an example of the present embodiment, the transport mechanism 100 can move along the first direction and the second direction. Thus, the transport mechanism can transport the object to be coated from a place outside the coating apparatus into the coating apparatus or transport the object to be coated from a place inside the coating apparatus outside the coating apparatus by the movement along the first direction, and place the object to be coated from the transport mechanism or grab the object to be coated from the coating platform through the movement along the second direction.

For example, in the coating apparatus provided by an example of the present embodiment, as illustrated by FIG. 2*b*, the transport mechanism 100 further includes a grabbing head 130, the grabbing head 130 is fixed with a sucking disc or a clamping jaw, which is used to suck and clamp the object to be coated.

For example, in the coating apparatus provided by an example of the present embodiment, as illustrated by FIG. 2*b*, the transport mechanism 100 further includes a first transport guide rail 110 and a second transport guide rail 120; the first transport guide rail 110 extends along the first direction, the transport mechanism 100 is configured to move along the first direction through the first transport guide rail 110; the second transport guide rail 120 extends along the second direction, the transport mechanism 100 is configured to move along the second direction through the second transport guide rail 120. Certainly, the present disclosure comprises but is not limited thereto, and the transport mechanism can be a robotic arm, so as to move the object to be coated to the coating platform or move the object to be coated which has been accomplished with the coating process out of the coating platform.

It is to be noted that, as illustrated by FIG. 2*b*, when the transport mechanism includes two sub transport mechanisms (for example, the first sub transport mechanism 101 and the second sub transport mechanism 102), two sub transport mechanisms can share the first transport guide rail 110.

For example, in the coating apparatus provided by an example of the present embodiment, as illustrated by FIG. 2*b*, the coating platform 200 is configured to move along a first direction and a third direction which is perpendicular to the first direction and the second direction and rotate in a plane perpendicular to the second direction. The third direction in FIG. 2*b* refers to a direction perpendicular to the paper plane, i.e., the third direction is perpendicular to the first direction and the second direction.

For example, in the coating apparatus provided by an example of the present embodiment, as illustrated by FIG. 1 and FIG. 2*b*, the coating platform 200 includes a first coating guide rail 210, a second coating guide rail 220 and a rotating portion 230. The first coating guide rail 210 extends along the first direction, the coating platform 200 is configured to move along the first direction through the first coating guide rail 210; the second coating guide rail 220 extends along the third direction, the coating platform 200 is configured to move along the third direction through the second coating guide rail 220; the rotating portion 230 can make the coating platform 200 rotate in a plane perpendicular to the second direction. The coating platform 200 can reach a position where the transport mechanism 100 is located to receive the object to be coated through the movements on the first coating guide rail 210 and the second coating guide rail 220; after the object to be coated has been accomplished with a coating process, the coating platform 200 can reach the position where the transport mechanism 100 is located again to give the object to be coated which has been accomplished with the coating process to the transport mechanism 100 through the movements on the first coating guide rail 210 and the second coating guide rail 220. The rotating portion 230 make the coating platform 200 rotate in the plane perpendicular to the second direction, for example, a rotating angle of the coating platform 200 in the plane perpendicular to the second direction has a range of 0°-360°, thereby enable the coater 300 to coat different edges of the object to be coated.

For example, as illustrated by FIGS. 5*a*-5*c*, upon accomplishing the front coating process and the back coating process of an edge of the object 900 to be coated, the coating head 310 can rotate in the plane perpendicular to the second direction to rotate the object 900 to be coated, in this way, another edge to be coated of the object 900 to be coated is rotated to a side close to the coating head 310, so as to make the coater 300 coat different edges of the object to be coated.

For example, the coating apparatus provided by an example of the present embodiment further includes: an alignment mechanism, configured to align the object to be coated on the coating platform and the coater.

Third Embodiment

Figure 3:
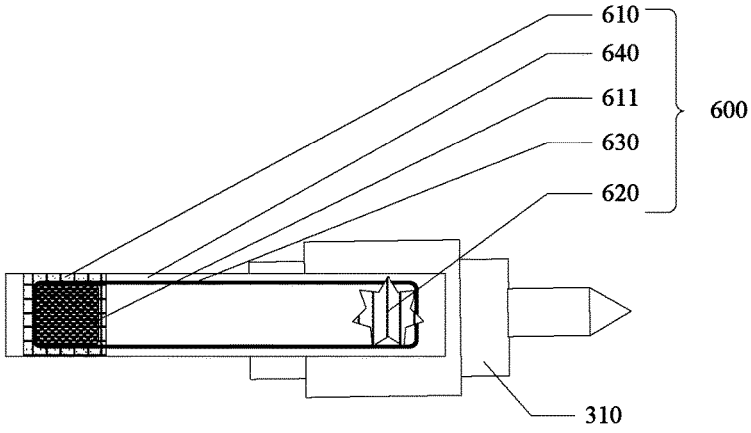
FIG. 3 is a structural schematic diagram of a coater provided by an embodiment of the present disclosure.

On the basis of the first embodiment, the present embodiment provides a coating apparatus. As illustrated by FIG. 3, the rotating structure 600 which is used to make the coating head 310 rotate in a plane perpendicular to the first direction may include: a driving motor 610, a coating head shaft 620 and a driving belt 630. The driving electrode 610 includes an output shaft 611, the output shaft 611 can rotate around an axis parallel to the first direction; the coating head shaft 620 is fixed with the coating head 310, the coating head 310 can rotate with the rotation of the coating head shaft 620, and an axis direction of the coating head shaft 620 is the first direction; and the driving belt 630 is connected with the output shaft 611 and the coating head shaft 620. Thus, upon rotating in a plane perpendicular to the first direction, the output shaft 611 of the driving motor 610 can drive the coating head shaft 620 to rotate in the plane perpendicular to the first direction through the driving belt 630, so as to drive the coating head 310 to rotate in the plane perpendicular to the first direction.

For example, in the coating apparatus provided by an example of the present embodiment, the rotating structure 600 further includes a fixing portion 640. The output shaft 611 and the coating head shaft 620 are disposed at two ends of the fixing portion 640 to fix the relative position of the output shaft 611 and the coating head shaft 620, so as to make the coating head 310 rotate precisely and stably in the plane perpendicular to the first direction, so as to further guarantee the precision of coating.

It is to be noted that, the rotating structure provided by the present disclosure includes but is not limited thereto, and the rotating structure can adopt the other structures. For example, a rotating shaft and a driving motor are disposed inside the coating head.

Figure 4:
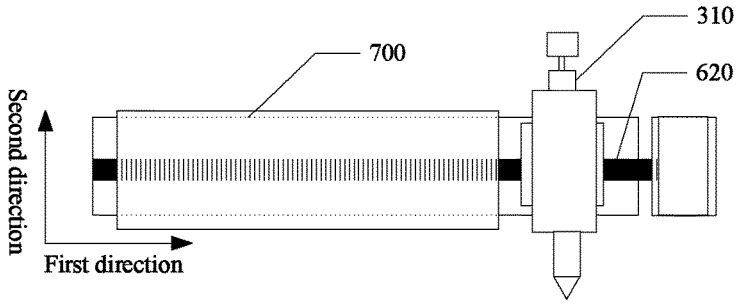
FIG. 4 is a structural schematic diagram of another coater provided by an embodiment of the present disclosure.

For example, in the coating apparatus provided by an example of the present embodiment, as illustrated by FIG. 4, the coater 300 further include a curing lamp 700, the curing lamp 700 and the coating head 310 are sequentially disposed along the first direction, and the curing lamp 700 is configured to cure liquid curable adhesive coated by the coating head 310. Thus, upon the coating head 310 being used to coat liquid photo-curable adhesive (for example, ultraviolet light curable adhesive), the curing lamp 700 sequentially disposed with the coating head 310 can quickly cure the coated liquid photo-curable adhesive, so as to prevent the defects caused by the fluxion of the liquid photo-curable adhesive.

For example, the curing lamp 700 and the coating head shaft 620 are fixedly connected, and the output shaft 611 drives the curing lamp 700 to rotate in a plane perpendicular to the first direction, i.e., move along a curved line in the plane perpendicular to the first direction, through the driving belt 630 and the coating head shaft 620. The curing lamp 700 can simultaneously cure the liquid photo-curable adhesive upon the coater 300 performing the coating process.

For example, the curing lamp 700 may not be rotate in the plane perpendicular to the first direction with the coating head shaft 620.

For example, the curing lamp 700 can be an ultraviolet light curing lamp.

For example, the light source of the curing lamp 700 can be a laser emitter, and the curing lamp 700 can emit parallel light source.

For example, the curing lamp 700 can be integrated with the coating head 310, and formed inside the coating head 310.

For example, the liquid photo-curable adhesive may be liquid optical adhesive, photoresist, and so on.

Fourth Embodiment

The embodiment of the present disclosure provides an operating method of a coating apparatus, which includes: an operation of front coating process, an operation of back coating process, and an operation of side sealing process.

For example, the operation of front coating process includes: the transport mechanism moves along a first direction and a second direction, to transport the object to be coated to a predetermined position; the coating platform moves along the first direction and a third direction, to move to a position under the predetermined position where the transport mechanism is located to receive the object to be coated, at this time, the transport mechanism can place the object to be coated on the coating platform by the movement along the second direction; the transport mechanism can move back to the initial position along the first direction and the second direction; the coating platform moves along the first direction and the third direction, to reach a coating position under the help of an alignment mechanism, and waits the coater to accomplish the coating motions; the coater moves along the second direction, and its height and rotating angle are adjusted, so as to make the coating head move to a position above the coating platform and be located in a downward position (as illustrated by FIG. 5*a*), so as to perform a front coating process to a position to be coated of the object 900 to be coated and accomplish the coating process; after the coater accomplishing the coating motions, the coating platform moves along the first direction and the third direction, to carry the object to be coated which has been accomplished with the coating process to a shift out position, and waits the transport mechanism to take; and the transport mechanism moves along the first direction and the second direction to the shift out position, to carry the object to be coated which has been accomplished with the coating process out.

For example, the operation of back coating process includes: the transport mechanism moves along the first direction and the second direction, to transport the object to be coated to a predetermined position; the coating platform moves along the first direction and the third direction, and moves to a position under the predetermined position where the transport mechanism is located, to receive the object to be coated. At this time, the transport mechanism can place the object to be coated on the coating platform by the movement along the second direction; the transport mechanism can move back to the initial position along the first direction and the second direction; the coating platform moves along the first direction and the third direction, to reach a coating position under the help of an alignment mechanism, and waits the coater to accomplish the coating motions; the coater moves along the second direction, and its height and rotating angle are adjusted, so as to make the coating head move to a position under the coating platform and be located in an upward position (as illustrated by FIG. 5*b*), so as to perform a back coating process to a position to be coated of the object to be coated and accomplish the coating process; after the coater accomplishing the coating motions, the coating platform moves along the first direction and the third direction, to transport the object to be coated which has been accomplished with the coating process to a shift out position, and waits the transport mechanism to take; and the transport mechanism moves along the first direction and the second direction to the shift out position, to carry the object to be coated which has been accomplished with the coating process out.

For example, the operation of side sealing process includes: the transport mechanism moves along the first direction and the second direction, to transport the object to be coated to a predetermined position; the coating platform moves along the first direction and the third direction, and moves to a position under the predetermined position where the transport mechanism is located, to receive the object to be coated. At this time, the transport mechanism can place the object to be coated on the coating platform by the movement along the second direction; the transport mechanism can move back to the initial position along the first direction and the second direction; the coating platform moves along the first direction and the third direction, to reach a coating position under the help of an alignment mechanism, and waits the coater to accomplish the coating motions; the coater moves along the second direction, and its height and rotating angle are adjusted, so as to make the coating head move to a position above the coating platform and be located in a position level with the position to be coated of the object to be coated (as illustrated by FIG. 5*c*), so as to perform a side sealing process to a position to be coated of the object to be coated and accomplish the coating process; after the coater accomplishing the coating motions, the coating platform moves along the first direction and the third direction, to transport the object to be coated which has been accomplished with the coating process to a shift out position, and waits the transport mechanism to take; and the transport mechanism moves along the first direction and the second direction to the shift out position, to carry the object to be coated which has been accomplished with the coating process out.

It is to be noted that, the abovementioned operation of front coating process, operation of back coating process and operation of side sealing process can be conducted to the same object to be coated, in this case, it is only required to carry the object to be coated to the predetermined position through the transport mechanism, move to the coating position through the coating platform, and adjust the height and rotating angle of the coater to respectively perform the operation of front coating process, operation of back coating process and operation of side sealing process (irrespective of sequence); at last, the object to be coated can be carried out through the transport mechanism.

The following statements should be noted:

(1) Unless otherwise defined, the same reference number represents the same meaning in the embodiments and drawings in the disclosure.

(2) The accompanying drawings involve only the structure(s) in connection with the embodiment(s) of the present disclosure, and other structure(s) can be referred to common design(s).

(3) For the purpose of clarity only, in accompanying drawings for illustrating the embodiment(s) of the present disclosure, the thickness and size of a layer or a structure may be enlarged. However, it should understood that, in the case in which a component or element such as a layer, film, area, substrate or the like is referred to be "on" or "under" another component or element, it may be directly on or under the another component or element or a component or element is interposed therebetween.

The foregoing is only the preferred embodiments of the present invention and not intended to limit the scope of protection of the present invention. The scope of protection of the present invention should be defined by the appended claims.

The application claims priority to the Chinese patent application No. 201621156305.2 filed Oct. 24, 2016, the disclosure of which is incorporated herein by reference as part of the application.

The invention claimed is:

1. A coating apparatus, comprising:

a coater, configured to move and perform coating along a first direction, wherein the coater comprises a coating head and a coating head movement mechanism, the coating head movement mechanism is configured to make the coating head move along a plane intersected with the first direction and rotate in the plane intersected with the first direction, the coating head movement mechanism is configured to make the coating head move along a second direction perpendicular to the coating platform, the coating head movement mechanism comprises: a first propulsion mechanism, configured to make the coating head move along the second direction; and a rotating structure, configured to make the coating head rotate in a plane perpendicular to the first direction, the rotating structure comprises: a driving motor, comprising an output shaft configured to rotate around an axis parallel to the first direction; a coating head shaft, fixed with the coating head, wherein an axis direction of the coating head shaft is the first direction; and a driving belt, wherein the driving belt is connected with the output shaft and the coating head shaft.

2. The coating apparatus according to claim 1, further comprising: a transport mechanism and/or a coating platform, wherein the transport mechanism is configured to transport an object to be coated, and the coating platform is configured to support the object to be coated, the first direction is parallel to a plane where the coating platform is located.

3. The coating apparatus according to claim 2, wherein the coating head movement mechanism is configured to make the coating head rotate in a plane perpendicular to the first direction.

4. The coating apparatus according to claim 3, wherein the transport mechanism is configured to move along the first direction and the second direction.

5. The coating apparatus according to claim 3, wherein the transport mechanism comprises:

a first transport guide rail, extending along the first direction, wherein the transport mechanism is configured to move along the first direction through the first transport guide rail; and a second transport guide rail, extending along the second direction, wherein the transport mechanism is configured to move along the second direction through the second transport guide rail.

6. The coating apparatus according to claim 3, wherein the coating platform is configured to move along the first direction and a third direction which is perpendicular to the first direction and the second direction and rotate in a plane perpendicular to the second direction.

7. The coating apparatus according to claim 6, wherein the coating platform comprises:

a first coating guide rail, extending along the first direction, wherein the coating platform is configured to move along the first direction through the first coating guide rail;

a second coating guide rail, extending along the third direction, wherein the coating platform is configured to move along the third direction through the second coating guide rail; and a rotation part configured to make the coating platform rotate in the plane perpendicular to the second direction.

8. The coating apparatus according to claim 6, wherein a rotating angle of the coating platform in the plane perpendicular to the second direction has a rotating range of 0°-360°.

9. The coating apparatus according to claim 2, wherein the transport mechanism comprises a first sub transport mechanism and a second sub transport mechanism, the first sub transport mechanism is configured to move the object to be coated to the coating platform, the second sub transport mechanism is configured to move the object to be coated out of the coating platform.

10. The coating apparatus according to claim 1, further comprising:

a second propulsion mechanism, comprising a first guide rail, wherein the first guide rail is extending along the first direction, the coater is disposed on the first guide rail, and the first propulsion mechanism is configured to make the coater move along the first direction.

11. The coating apparatus according to claim 1, wherein the rotating structure further comprises:

a fixing portion, wherein the output shaft and the coating head shaft are respectively disposed at two ends of the fixing portion, so as to fix the relative position between the output shaft and the coating head shaft.

12. The coating apparatus according to claim 1, further comprising:

a curing lamp, wherein the curing lamp and the coating head are sequentially disposed along the first direction, and the curing lamp is configured to cure liquid curable adhesive coated by the coating head.

13. The coating apparatus according to claim 12, wherein the curing lamp is fixed to the coating head shaft, and the output shaft drives the curing lamp to rotate in a plane perpendicular to the first direction through the driving belt and the coating head shaft.

* * * * *